US005713778A

United States Patent [19]

Radosevich et al.

[11] Patent Number: 5,713,778

[45] Date of Patent: Feb. 3, 1998

[54] DOLL WITH SIMULATED BOWEL MOVEMENT

[75] Inventors: Roseann Radosevich, New Bedford, Mass.; Ralph A. Beckman, Providence, R.I.; Gregory L. Gerold, Cincinnati, Ohio; John Murphy, North Scituate; Stephen A. Schwartz, Providence, both of R.I.

[73] Assignees: Design Lab LLC; Steven A. Schwartz, both of Providence, R.I.; Roseann Radosevitch, New Bedford, Mass.

[21] Appl. No.: 688,792

[22] Filed: Jul. 31, 1996

[51] Int. Cl.[6] ..... A63H 3/24

[52] U.S. Cl. ..... 446/304; 446/320; 446/296; 446/330

[58] Field of Search ..... 446/295, 304, 446/305, 320, 330, 296; 434/127, 262, 268

[56] References Cited

U.S. PATENT DOCUMENTS

| | | | |
|---|---|---|---|
| 2,448,088 | 8/1948 | Driggs | 446/320 |
| 2,586,081 | 2/1952 | Philippi | 446/304 |
| 3,641,703 | 2/1972 | Tepper et al. | 446/295 |
| 3,660,930 | 5/1972 | Indjian . | |
| 3,858,352 | 1/1975 | Cummings et al. | 446/305 |
| 4,192,092 | 3/1980 | Goldfarb et al. . | |
| 4,237,649 | 12/1980 | Goldfarb et al. | 446/330 |
| 4,443,200 | 4/1984 | Murphy | 434/268 |
| 4,565,536 | 1/1986 | Vairo | 446/305 |
| 4,836,821 | 6/1989 | Raymond | 446/330 |
| 5,037,345 | 8/1991 | Nakayama | 446/297 |
| 5,094,644 | 3/1992 | Kelley | 446/305 |

FOREIGN PATENT DOCUMENTS

| | | | |
|---|---|---|---|
| 496224 | 10/1950 | Belgium | 446/475 |
| 411090 | 3/1925 | Germany | 446/305 |
| 2059237 | 12/1970 | Germany | 446/305 |
| 2113366 | 10/1971 | Germany . | |
| 2134802 | 8/1984 | United Kingdom . | |
| WO 89/01812 | 3/1989 | WIPO . | |

*Primary Examiner*—Robert A. Hafer
*Assistant Examiner*—Jeffrey D. Carlson
*Attorney, Agent, or Firm*—Fish & Richardson P.C.

[57] ABSTRACT

A doll includes a torso having an opening. A simulated bowel movement may be moved through the opening between positions respectively inside and outside the torso.

17 Claims, 6 Drawing Sheets

DOLL WITH SIMULATED BOWEL MOVEMENT

BACKGROUND OF THE INVENTION

The invention relates to toy dolls.

SUMMARY OF THE INVENTION

The invention features a toy doll that is capable of exhibiting a simulated bowel movement. When a feeding bottle is inserted into the doll's mouth, the simulated bowel movement is extended from an opening in the doll's torso. Wiping the bowel movement toward the rear of the torso causes the bowel movement to be retracted into the opening. The simulated bowel movement promises to add to a child's enjoyment when playing with the doll.

In one aspect, generally, the invention features a doll having a torso with an opening. The doll also includes a simulated bowel movement configured to be moved through the opening between positions respectively inside and outside the torso.

Embodiments of the invention may include one or more of the following features. The doll may have a drive mechanism configured to drive the simulated bowel movement through the opening in response to a user's manipulation, and a shaft connected to the simulated bowel movement and positioned in the torso. The doll also may include a head connected to the torso, and the drive mechanism may be positioned in the head and is configured to push against the shaft to extend the simulated bowel movement out of the opening in the torso. A coupling may be connected between the drive mechanism and the shaft. The coupling may be configured to permit rotation of the head relative to the torso. For example, the coupling may be a ball-and-joint socket.

The drive mechanism may include first and second components coupled to convert axial motion of the first component in a first direction to axial motion of the second component in a second direction. Axial motion of the first component may be induced by an object (e.g., the end of a bottle) inserted into the doll's mouth. Axial motion of the second component may cause the second component to push against the shaft and extend the simulated bowel movement out of the opening. Relatively smaller axial motion by the first component may result in relatively larger axial motion by the second component. Accordingly, inserting the end of a bottle a short distance into the mouth may result in the simulated bowel movement being extended a longer distance out of the opening.

The shaft may include a latch configured to engage the torso to maintain the simulated bowel movement in an extended position. A spring may be connected to the shaft to retract the simulated bowel movement when the latch is disengaged from the torso. The latch may be configured to disengage from the torso in response to displacement of the simulated bowel movement toward a rear of the torso by, for example, wiping of the bowel movement toward the rear of the torso.

The simulated bowel movement may be configured to be extended from the opening in the torso in response to insertion of an object, such as a bottle, into the doll's mouth. In particular, the drive mechanism may be configured so that insertion of the bottle causes axial movement of the first component of the drive mechanism. Resulting axial movement of the second component of the drive mechanism extends the simulated bowel movement from the opening.

The bottle may have an end configured for insertion into the doll's mouth. The bottle also may be configured to simulate ingestion of food by the doll.

Other features, objects, and advantages of the invention will become apparent from the following detailed description, including the drawings, and from the claims.

DESCRIPTION OF THE PREFERRED EMBODIMENTS

Figure 1:
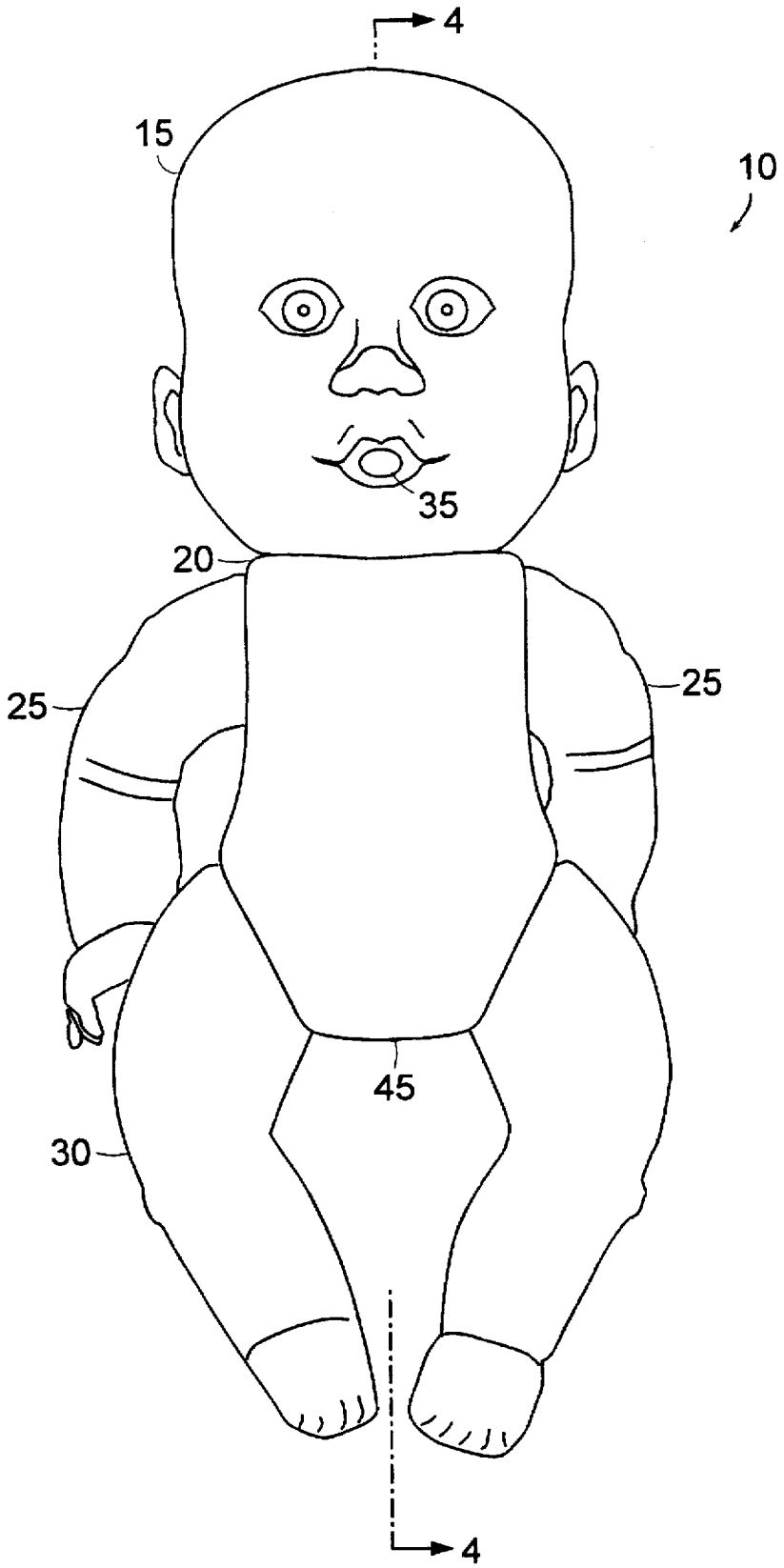
FIGS. 1–3 are front and side views of a doll.
Figure 2:
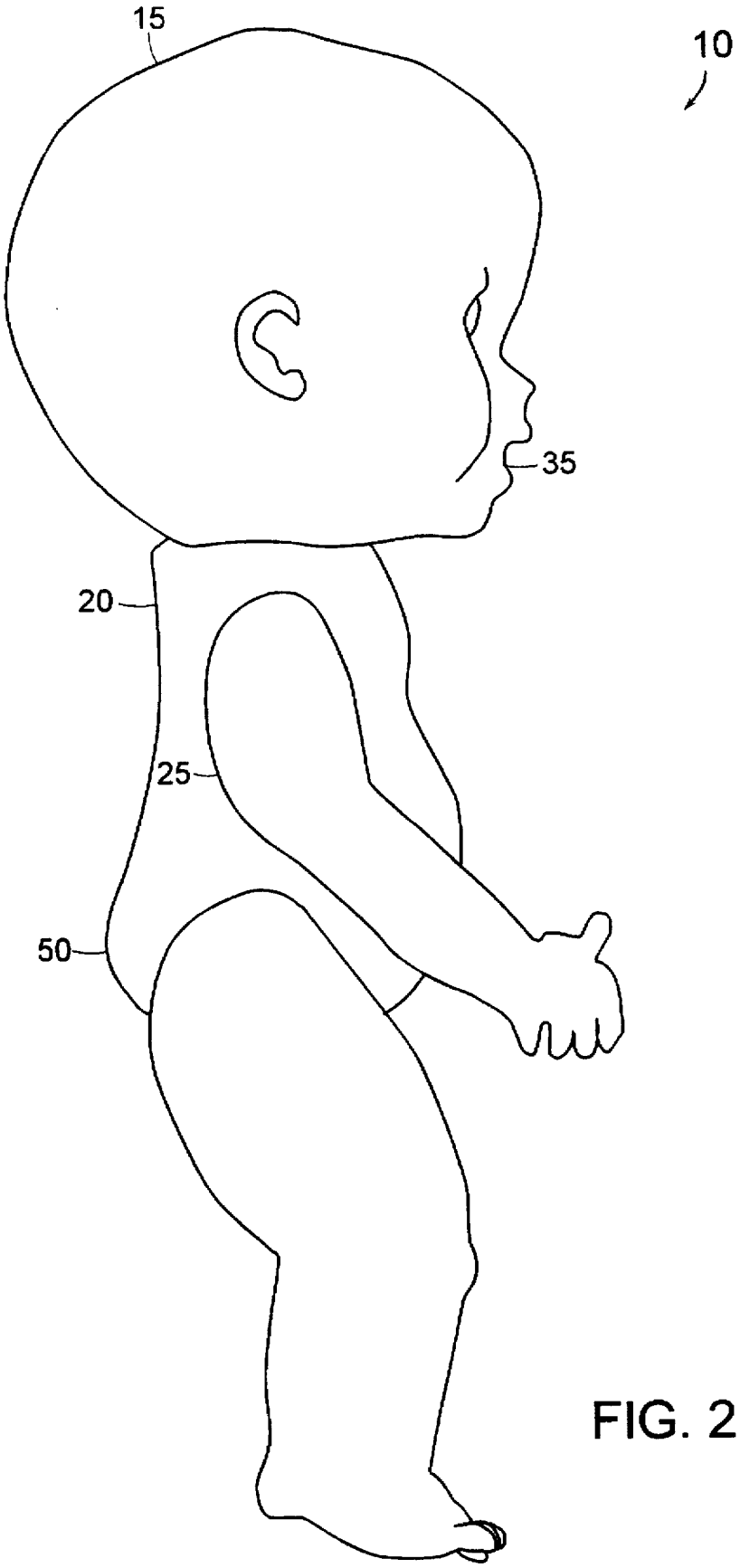
Figure 3:
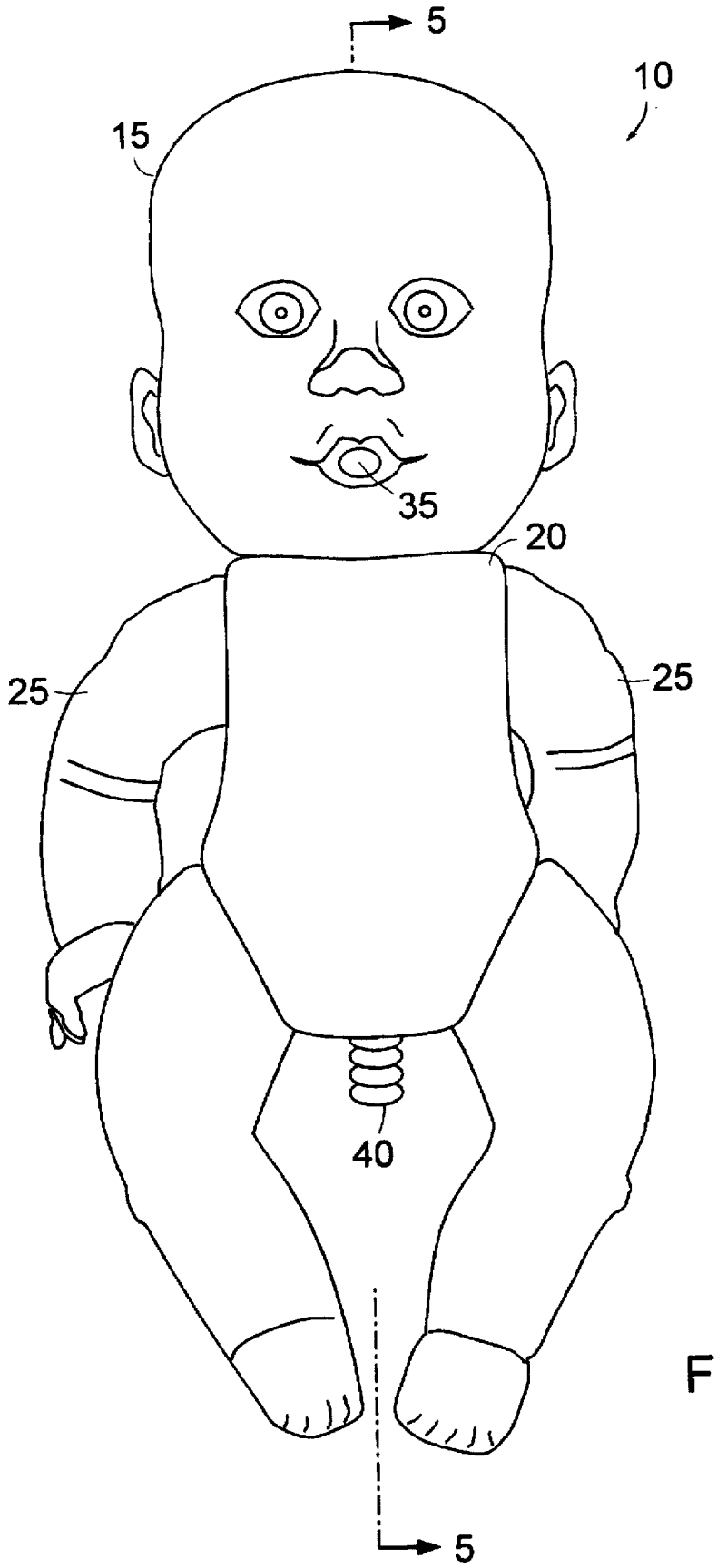

Referring to FIGS. 1–3, a doll 10 includes a head 15, a torso 20, arms 25 and legs 30. The head is attached to the torso and may be rotated relative to the torso. Similarly, the arms and legs are attached to the torso and are movable relative to the torso.

Insertion of an object (e.g., the end of a bottle) into the mouth 35 of the doll 10 causes a simulated bowel movement 40 (FIG. 3) to extend from an opening 45 in the torso of the doll. In particular, the simulated bowel movement 40 extends from the opening as the object is inserted. Wiping the simulated bowel movement toward the rear 50 of the doll causes the bowel movement to be retracted into the opening.

Figure 4:
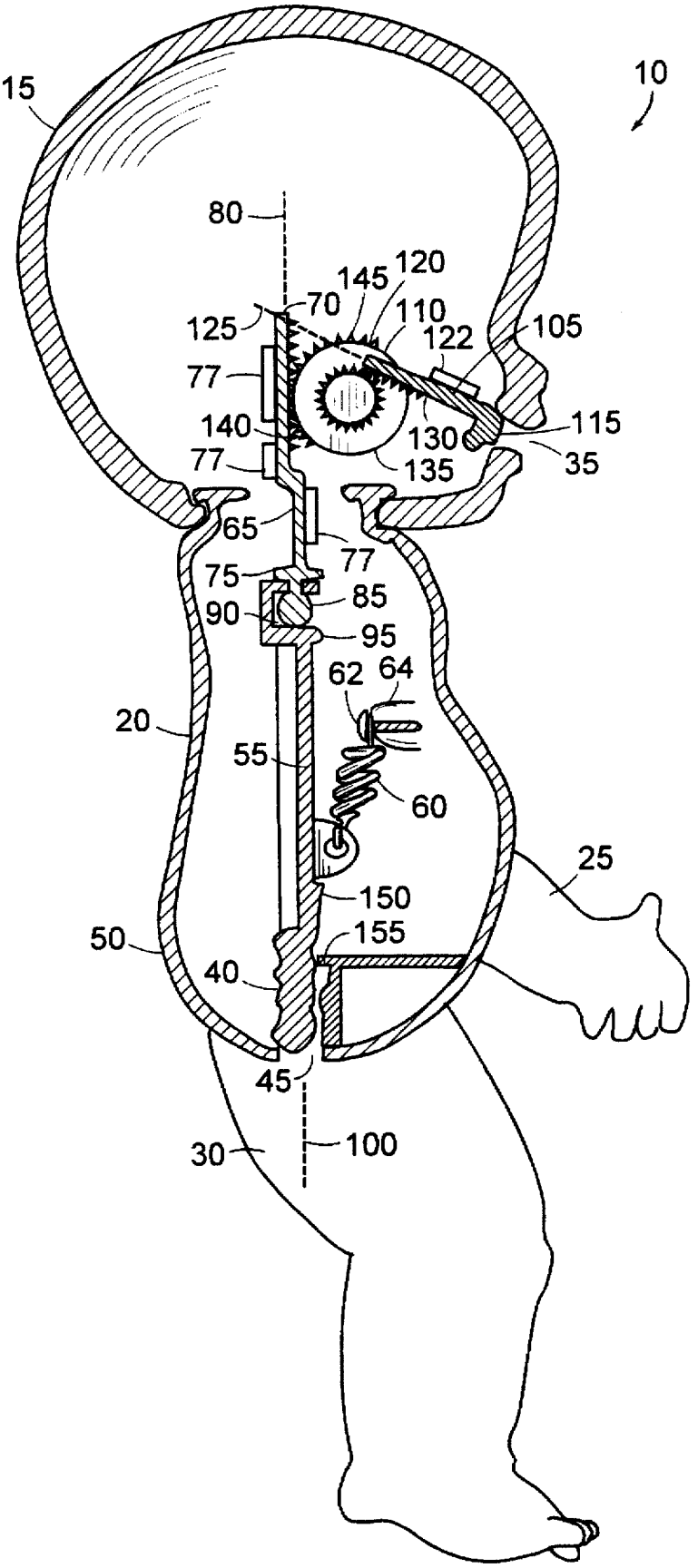
FIG. 4 is a sectional view taken along section 4—4 of FIG. 1.
Figure 5:
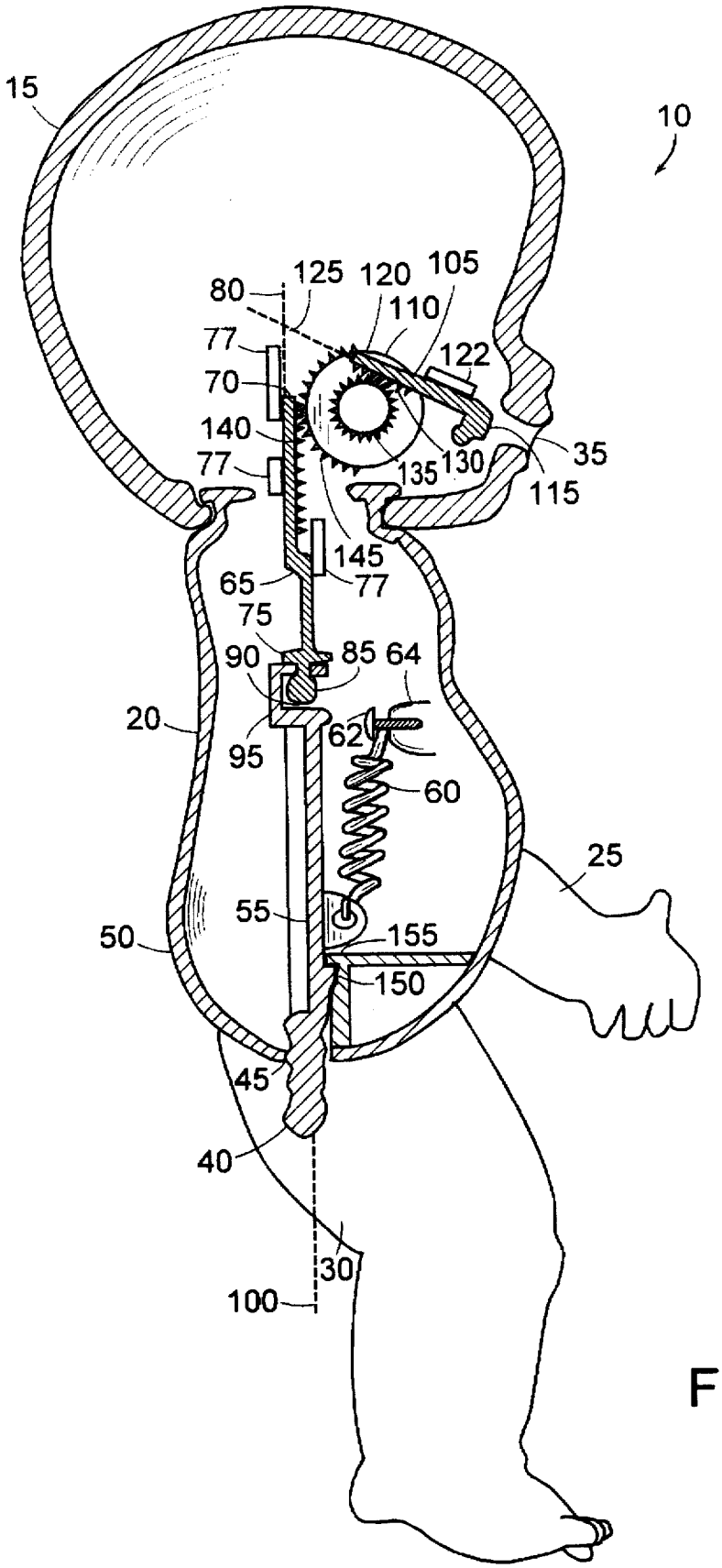
FIG. 5 is a sectional view taken along section 5—5 of FIG. 3.

Referring to FIGS. 4 and 5, the simulated bowel movement 40 is attached to a shaft 55 that is positioned within the torso 20. The shaft is aligned with the simulated bowel movement and is oriented relative to the torso of the doll so that downward movement of the shaft causes the simulated bowel movement to extend from the bottom of the torso. The shaft also may be aligned so that downward movement would cause the simulated bowel movement to extend toward the rear of the torso.

A spring 60 is connected between the shaft 55 and a screw 62 attached to an interior surface 64 of the torso 20. The spring is oriented to pull the shaft away from the opening 45 to hold the simulated bowel movement within the torso and to pull the shaft toward the front of the torso 20.

A first ram 65 is positioned within the head 15 and the torso 20 of the doll. The ram includes a first end 70 that is positioned within the head and a second end 75 that is positioned within the torso. Guides 77 within the torso control the orientation of the ram so that the ram may move along an axis 80 defined by the ends 70, 75.

A ball 85 of a ball-and-socket joint 90 is connected to the end 75 of the ram 65. The socket 95 of the joint is connected to the shaft 55 so that the joint couples the shaft to the first ram. The joint permits the head of the doll to rotate relative to the torso without interference from the joint and also permits the orientation of a longitudinal axis 100 of the shaft to vary relative to the axis 80.

The first ram 65 is coupled to a second ram 105 by a gear wheel 110. The second ram 110 includes a first end 115 that is aligned with the mouth 35 of the doll and a second end 120 that is adjacent to the gear wheel 110. A guide 122 holds the second ram against the gear wheel 110 so that the second ram may be moved along an axis 125 defined by the ends 115, 120.

Teeth 130 on the second end 120 of the second ram cooperate with a first set of teeth 135 on the gear wheel 110 to cause rotational motion of the gear wheel in response to axial motion of the second ram. Teeth 140 on the first end 70 of the first ram cooperate with a second set of teeth 145 on the gear wheel to cause axial motion of the first ram in response to rotational motion of the gear wheel. Accordingly, axial motion of the second ram causes axial motion of the first ram. Spacing between teeth of the first set 135 is smaller than spacing between teeth of the second set 145 so that axial movement of the first ram results in larger axial movement of the second ram.

The shaft 55 includes a latch 150 that engages with a lip 155 within the torso 20 to maintain the simulated bowel movement in an extended position. Wiping of the simulated bowel movement toward the rear of the torso causes the latch to disengage from the lip. This permits the spring 60 to retract the simulated bowel movement into the torso.

Insertion of an object into the mouth 35 of the doll pushes the second ram toward the gear wheel. Movement of the second ram rotates the gear wheel in a counterclockwise direction. Rotation of the gear wheel pushes the first ram against the shaft to extend the simulated bowel movement out of the opening 45.

As noted above, the spring exerts a force against the shaft. This, in turn, exerts a force against the first ram, and against the second ram through the gear wheel. Accordingly, removal of the bottle when the simulated bowel movement is extended only partially will permit the spring to retract the simulated bowel movement into the torso of the doll and to move the second ram toward the mouth of the doll. When the simulated bowel movement is fully extended, the latch engages the lip within the torso so that the simulated bowel movement remains in the extended position when the bottle is removed.

Figure 6:
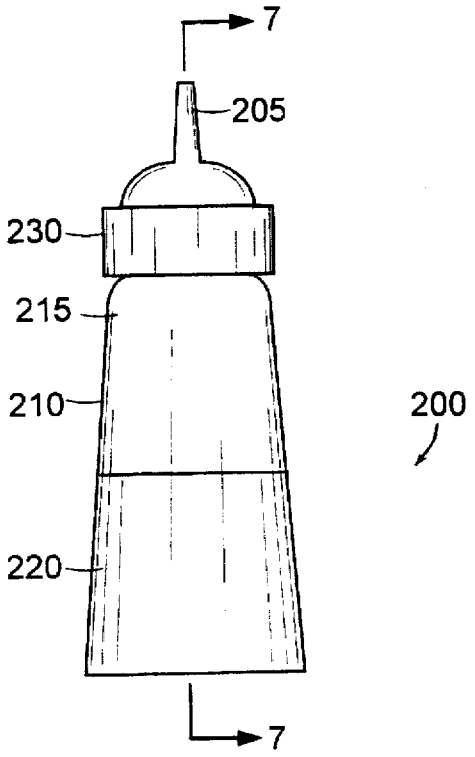
FIG. 6 is a side view of a bottle.
Figure 7:
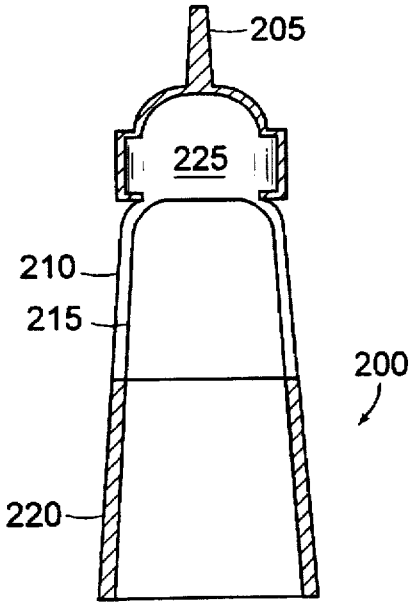
FIG. 7 is a sectional view taken along section 7—7 of FIG. 6.

Referring to FIGS. 6 and 7, a bottle 200 includes an end 205 that is configured for insertion into the mouth 35 (FIG. 1) of the doll. The bottle 200 includes an outer shell 210 and an inner shell 215. Opaque liquid 220 occupies a space between the two shells and is colored to resemble milk. The liquid makes the bottle appear to be half full when the bottle is in an upright position. When the bottle is tilted and placed in the doll's mouth, the liquid drains into a reservoir 225 in the cap 230 of the bottle so that the doll appears to be drinking the milk.

Other embodiments are within the scope of the following claims.

What is claimed is:

1. A doll comprising:

a torso having an opening;

a simulated bowel movement configured to be moved through the opening between positions respectively inside and outside the torso;

a shaft connected to the simulated bowel movement and positioned in the torso;

a drive mechanism configured to drive the simulated bowel movement through the opening in response to a user's manipulation;

a coupling connected between the drive mechanism and the shaft; and a head connected to the torso at an end of the torso opposite an end of the torso that includes the opening;

wherein the coupling is configured to permit rotation of the head relative to the torso.

2. The doll of claim 1, wherein the coupling comprises a ball-and-joint socket.

3. The doll of claim 1, further comprising a latching element configured to maintain the simulated bowel movement in an extended position.

4. The doll of claim 1, wherein the simulated bowel movement is configured to be retracted into the opening in the torso in response to displacement of the simulated bowel movement toward a rear of the torso.

5. A doll comprising:

a torso having an opening, a simulated bowel movement configured to be moved through the opening between positions respectively inside and outside the torso, and a latching element configured to maintain the simulated bowel movement in an extended position, wherein the latching element is configured to disengage from the torso in response to displacement of the simulated bowel movement toward a rear of the torso.

6. The doll of claim 5, further comprising a drive mechanism configured to drive the simulated bowel movement through the opening in response to a user's manipulation.

7. The doll of claim 6, further comprising a shaft connected to the simulated bowel movement and positioned in the torso.

8. The doll of claim 7, further comprising a head connected to the torso at an end of the torso opposite an end of the torso that includes the opening.

9. The doll of claim 8, wherein the drive mechanism is positioned in the head and is configured to push against the shaft.

10. The doll of claim 8, further comprising a coupling connected between the drive mechanism and the shaft.

11. The doll of claim 6, wherein the drive mechanism comprises a first component and a second component coupled to the first component to convert axial motion of the first component in a first direction to axial motion of the second component in a second direction.

12. The doll of claim 11, wherein smaller axial motion by the first component results in larger axial motion by the second component.

13. The doll of claim 5, further comprising a biasing element to bias the simulated bowel movement to be inside the torso.

14. The doll of claim 5, further comprising a head connected to the torso and including a mouth, wherein the simulated bowel is configured to be extended from the opening in the torso in response to insertion of an object into the mouth.

15. The doll of claim 14, further comprising a bottle having an end configured for insertion into the mouth of the doll.

16. A doll comprising:

a torso having an opening, a simulated bowel movement configured to be moved through the opening between positions respectively inside and outside the torso, a latching element configured to maintain the simulated bowel movement in an extended position, a shaft connected to the simulated bowel movement and positioned in the torso, and a spring connected to the shaft and configured to retract the simulated bowel movement when the latching element is disengaged from the torso.

17. The doll of claim 16, wherein the simulated bowel movement is configured to be retracted into the opening in the torso in response to displacement of the simulated bowel movement toward a rear of the torso.

* * * * *